US007964030B1

(12) United States Patent
Nakatsugawa et al.

(10) Patent No.: US 7,964,030 B1
(45) Date of Patent: Jun. 21, 2011

(54) MAGNESIUM COATING SOLUTION AND METHOD FOR PREPARING THE SAME

(75) Inventors: Isao Nakatsugawa, Hamamatsu (JP); Wu-Bin Li, Shenzhen (CN); Bin-Lung Ou, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/870,995

(22) Filed: Aug. 30, 2010

(30) Foreign Application Priority Data

Apr. 12, 2010 (CN) ..... 2010 1 0144653

(51) Int. Cl.
*C23C 22/40* (2006.01)
*C23F 11/00* (2006.01)

(52) U.S. Cl. ..... 106/14.21; 106/14.11; 106/14.14; 106/14.44; 148/243; 148/248; 148/274; 148/275

(58) Field of Classification Search ..... 106/14.11, 106/14.14, 14.21, 14.44; 148/243, 248, 274, 148/275

See application file for complete search history.

(56) References Cited

U.S. PATENT DOCUMENTS

| | | | | |
|---|---|---|---|---|
| 3,960,676 | A * | 6/1976 | Miyosawa et al. | 205/172 |
| 4,828,615 | A * | 5/1989 | Cape | 106/14.13 |
| 5,772,865 | A * | 6/1998 | Tanaka et al. | 205/261 |
| 5,843,242 | A * | 12/1998 | Dolan | 148/272 |
| 6,692,583 | B2 * | 2/2004 | Bengston et al. | 148/261 |
| 6,755,918 | B2 * | 6/2004 | Ger et al. | 148/243 |
| 6,863,743 | B2 * | 3/2005 | Minevski et al. | 148/261 |
| 7,815,751 | B2 * | 10/2010 | Pemberton et al. | 148/247 |
| 2004/0101697 | A1 * | 5/2004 | Chida et al. | 428/461 |
| 2009/0130431 | A1 * | 5/2009 | Chida et al. | 428/325 |

FOREIGN PATENT DOCUMENTS

| | | | |
|---|---|---|---|
| JP | 2007-182634 | A * | 7/2007 |
| WO | WO2009/138022 | A1 * | 11/2009 |

OTHER PUBLICATIONS

Derwent-Acc-No: 2007-250664, abstract of Russian Patent Specification No. RU2291231 C1 (Jan. 2007).*

* cited by examiner

*Primary Examiner* — Anthony J Green
(74) *Attorney, Agent, or Firm* — Clifford O. Chi

(57) ABSTRACT

A vanadate solution for conversion treating of surface of a magnesium alloy workpiece contains $8.20\times10^{4}$ to $8.20\times10^{-2}$ mol/liter of metavanadate ion, $1.18\times10^{4}$ to $1.18\times10^{-2}$ mol/liter of a polyhydroxylated aromatic compound, and balance of water. The pH value of the vanadate solution exceeds 1 and is less than 4. A method for preparing the vanadate solution is also provided.

17 Claims, 5 Drawing Sheets

| Group | Vanadate solution | | | surface resistance (ohm) | corrosion resistance (grade) |
|---|---|---|---|---|---|
| | Sodium metavanadate (mol/L) | Other component (mol/L) | pH | | |
| A1 | $1.64\times10^{-2}$ | --- | 2 | <1 | 8 |
| A2 | $1.64\times10^{-2}$ | oxalic acid $7.14\times10^{-4}$ | 2 | <1 | 7 |
| A3 | $1.64\times10^{-2}$ | citric acid $9.05\times10^{-4}$ | 2 | <1 | 7-8 |
| A4 | $1.64\times10^{-2}$ | gallic acid $1.06\times10^{-3}$ | 2 | <1 | 9 |

FIG. 2

| Group | Vanadate solution | | | Surface resistance (ohm) | Corrosion resistance (grade) |
|---|---|---|---|---|---|
| | Sodium metavanadate (mol/L) | Other component (mol/L) | pH | | |
| B1 | $2.46\times10^{-2}$ | gallic acid$1.65\times10^{-3}$ | 2 | <1 | 9 |
| B2 | $2.46\times10^{-2}$ | tannic acid$1.47\times10^{-4}$ | 2 | <1 | 8-9 |
| B3 | $2.46\times10^{-2}$ | L-ascorbic acid $1.48\times10^{-3}$ | 2 | <1 | 8-9 |

FIG. 3

| Group | Vanadate solution | | | Corrosion potential (mV) | Corrosion resistance (Kohm/cm$^2$) |
|---|---|---|---|---|---|
| | Sodium metavanadate (mol/L) | Gallic acid (mol/L) | pH | | |
| C1 | --- | --- | 2 | -1.527 | 4.1 |
| C2 | $2.46\times10^{-2}$ | --- | 2 | -1.535 | 20.5 |
| C3 | $2.46\times10^{-2}$ | $1.18\times10^{-4}$ | 2 | -1.560 | 18.3 |
| C4 | $2.46\times10^{-2}$ | $3.53\times10^{-4}$ | 2 | -1.565 | 24.8 |
| C5 | $2.46\times10^{-2}$ | $1.76\times10^{-3}$ | 2 | -1.587 | 32.3 |
| C6 | $2.46\times10^{-2}$ | $3.53\times10^{-3}$ | 2 | -1.592 | 18.8 |
| C7 | $2.46\times10^{-2}$ | $1.18\times10^{-2}$ | 2 | -1.580 | 6.3 |

FIG. 4

| Group | Vanadate solution | | | Quantity of corrosion (mg/s) | Surface resistance (ohm) | Corrosion resistance (grade) |
|---|---|---|---|---|---|---|
| | Sodium metavanadate (mol/L) | Gallic acid (mol/L) | pH | | | |
| D1 | $2.46\times10^{-2}$ | $1.76\times10^{-3}$ | 1 | 8.82 | <1 | 6 |
| D2 | $2.46\times10^{-2}$ | $1.76\times10^{-3}$ | 2 | 0.172 | <1 | 9 |
| D3 | $2.46\times10^{-2}$ | $1.76\times10^{-3}$ | 4 | 0.0044 | <1 | 6-7 |

FIG. 5

MAGNESIUM COATING SOLUTION AND METHOD FOR PREPARING THE SAME

BACKGROUND

1. Technical Field

The present disclosure relates to coating solutions for magnesium alloy, and more particularly, relates to a method of prepare a coating solution thereof.

2. Description of Related Art

Magnesium alloys, made up of magnesium and other metals such as aluminum and zinc, have become, in recent years, increasingly in demand in uses as structural materials for electronic products and vehicles. Since magnesium alloy can react easily with other chemical substances such as acids, before a workpiece is used, a protective film is generally layered on an outer surface to protect the workpiece. A good corrosion resistance and low surface resistance of the protective film are required.

A typical vanadate solution used for conversion coating/treating to a surface of a magnesium alloy workpiece contains compounds containing $V^{4+}$ (such as $VO^{2+}$) providing vanadium, and organic acid. The vanadate solution is capable of forming a protective film on an outer surface of the magnesium alloy workpiece. Metavanadate can also provide vanadium in the vanadate solution, and is less expensive. However, protective film formed by a vanadate solution containing metavanadate is very thin, thereby possibly having difficulty meeting the quality standards of corrosion resistance and surface resistance.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

FIG. 2 is a table showing the recipes of vanadate solutions as disclosed and test result in example one.

FIG. 3 is a table showing the recipes of vanadate solutions as disclosed and test result in example two.

FIG. 4 is a table showing the recipes of vanadate solutions as disclosed and test result in example three.

FIG. 5 is a table showing the recipes of vanadate solutions as disclosed and test result in example four.

DETAILED DESCRIPTION

Figure 1:
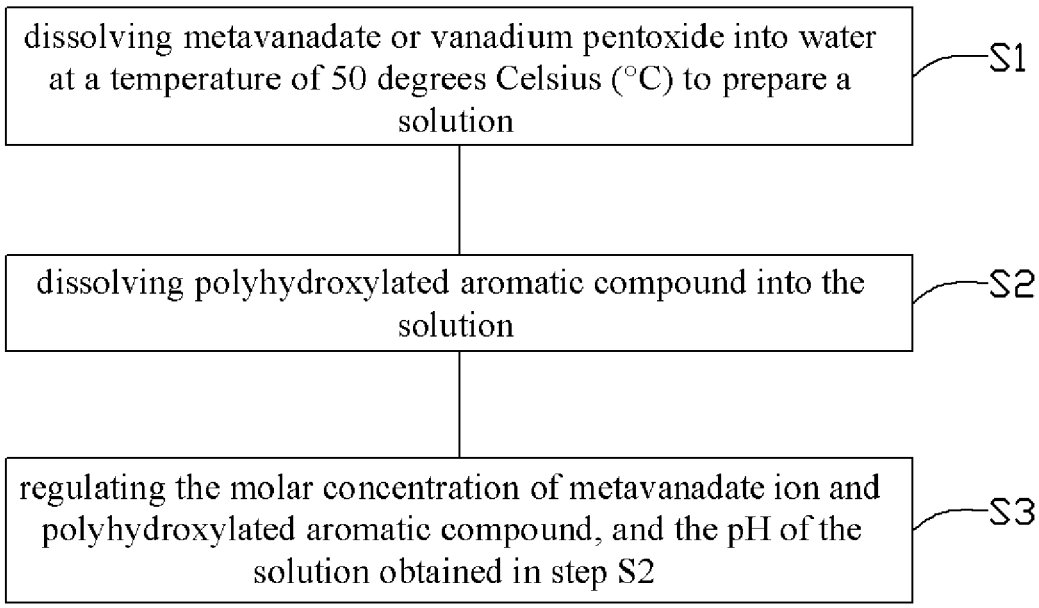
FIG. 1 is a flowchart of one embodiment of a method for preparing a vanadate solution.

The disclosed vanadate solution is used for conversion treating a surface of a magnesium alloy workpiece. The vanadate solution contains: $8.20\times10^{-4}$ to $8.20\times10^{-2}$ mol/liter of metavanadate ions, $1.18\times10^{-4}$ to $1.18\times10^{-2}$ mol/liter of polyhydroxylated aromatic compound, and balance of water. A pH value of the vanadate solution exceeds 1 and is less than 4.

The metavanadate ion is obtained by dissolving metavanadate or vanadium pentoxide ($V_2O_5$) into the vanadate solution. The metavanadate includes but is not limited to sodium metavanadate ($NaVO_3$), ammonium metavanadate ($NH_4VO_3$), and their combination. The polyhydroxylated aromatic compound includes but is not limited to tannic acid, L-ascorbic acid, gallic acid, and their combination. An agent used to regulate the pH value may be one or more organic acid or inorganic acid, such as nitric acid ($HNO_3$), sulfuric acid ($H_2SO_4$), phosphoric acid ($H_3PO_4$), hydrochloric acid (HCl) and their combinations, preferably sulfuric acid.

FIG. 1 shows a method for preparing a vanadate solution used for converting a treating surface of a magnesium alloy workpiece as follows.

In step S1, metavanadate or vanadium pentoxide is dissolved into water with the water at a temperature of about 50 degrees Celsius (° C.) to prepare a solution. Metavanadate ion is provided by the metavanadate or vanadium pentoxide. The metavanadate includes but is not limited to sodium metavanadate ($NaVO_3$), ammonium metavanadate ($NH_4VO_3$), and their combination.

In step S2, a polyhydroxylated aromatic compound is dissolved into the solution. The polyhydroxylated aromatic compound includes but is not limited to tannic acid, L-ascorbic acid, gallic acid, and their combination.

In step S3, regulating the molar concentration of the metavanadate ion and the polyhydroxylated aromatic compound, and the pH of the solution obtained in step S2. The concentration of the metavanadate ion ($VO_3$) is $8.20\times10^{-4}$ to $8.20\times10^{-2}$ mol/liter. The concentration of the polyhydroxylated aromatic compound is $1.18\times10^{-4}$ to $1.18\times10^{-2}$ mol/liter. The pH value exceeds 1 and is less than 4. The pH value is regulated by dissolving a proper agent into the solution. The agent used to regulate the pH value may be an organic acid or inorganic acid, such as nitric acid, sulfuric acid, phosphoric acid, hydrochloric acid and their combinations, preferably sulfuric acid.

Examples of vanadate solutions used for conversion treating of the surface of a magnesium alloy workpiece follow.

Example one: four groups (group A1, group A2, group A3 and group A4) of magnesium alloy workpieces were provided. A material of each of the magnesium alloy workpieces is AZ91D. The four groups of magnesium alloy workpieces were sanded using 800# sandpaper, washed with distilled water, degreased with ethanol, and the workpieces of group A1, group A2, group A3 and group A4 were submerged into the vanadate solutions (row A1, row A2, row A3 and row A4) shown in FIG. 2 correspondingly for about 5 minutes to form protective films on the workpieces; followed by washing with distilled water and drying at 100° C.

Corrosion resistance and surface resistance of the four groups of magnesium alloy workpieces were evaluated after the processes described. Corrosion resistance was evaluated by a salt spray tester using 5% sodium chloride (NaCl) solution for about 8 hours, grade of corrosion area was evaluated by ASTM-B117, and surface resistance was evaluated using a micro-ohmmeter (Lorester EP ' Mitsubishi Chemical).

As shown in FIG. 2, surface resistance of the magnesium alloy workpieces after conversion treating by vanadate solutions shown in row A1, row A2, row A3 and row A4 was all less than 1Ω, and the corrosion resistance of the magnesium alloy workpiece after conversion treating by vanadate solutions shown in row A4 was grade 9. Therefore, the magnesium alloy workpiece after conversion treating by vanadate solution shown in row A4 of FIG. 2 has good corrosion resistance, and lower surface resistance. It is understood that if the magnesium alloy workpieces are used to make portable electronic devices, the portable electronic devices may have good electromagnetic interference shielding efficiency. The vanadium in the protective film is provided by metavanadate or vanadium pentoxide, thus that the vanadate solution has a relatively low cost. Furthermore, the vanadate solution contains no phosphide or chromium pollutants, thus complying with environmental guidelines.

Example two: three groups (group B1, group B2 and group B3) of magnesium alloy workpieces were provided. A material of each of the magnesium alloy workpieces is AZ91D. The three groups of magnesium alloy workpieces were sanded using 800# sandpaper, washed with distilled water, degreased with ethanol, and the workpieces of group A1, A2 group A2 and group A3 were submerged into the vanadate solutions (row A1, row A2 and row A3) shown in FIG. 3 correspondingly for about 2 minutes to form protective films on the workpieces; followed by washing with distilled water and drying at 100° C. As shown in FIG. 3, the metavanadate in the vanadate solutions are all sodium metavanadate, the polyhydroxylated aromatic compound in the vanadate solutions in row A1, row A2 and row A3 are gallic acid, tannic acid and L-ascorbic acid respectively.

Corrosion resistance and surface resistance of the three groups of magnesium alloy workpieces were evaluated after the processes described. Corrosion resistance was evaluated by a salt spray tester using 5% sodium chloride (NaCl) solution for about 8 hours, grade of corrosion area was evaluated by ASTM-B117 and surface resistance was evaluated using a micro-ohmmeter (Lorester EP ' Mitsubishi Chemical).

As shown in FIG. 3, surface resistance of the magnesium alloy workpieces after conversion treating by vanadate solutions shown in row A1, row A2 and row A3 was all less than 1Ω, and the corrosion resistance of the magnesium alloy workpiece after conversion treating by vanadate solutions shown in row A1, row A2 and row A3 is all above grade 8. The corrosion resistance of magnesium alloy workpiece after conversion treating by vanadate solutions shown in row A1 containing gallic acid was grade 9. Therefore, the magnesium alloy workpiece after conversion treating by vanadate solution shown in row A1, row A2 and row A3 of FIG. 3 have good corrosion resistance, and lower surface resistance. It was found that if the polyhydroxylated aromatic compound in the vanadate solution is gallic acid, the magnesium alloy workpiece after conversion treating exhibits excellent corrosion resistance. It is understood that, if the magnesium alloy workpieces are used to make portable electronic devices, the portable electronic device may have good electromagnetic interference shielding efficiency.

Example three: seven groups (group C1, group C2, group C3, group C4, group C5, group C6, and group C7) of magnesium alloy workpieces were provided. A material of each of the magnesium alloy workpieces is AZ91D. The three groups of magnesium alloy workpieces were sanded using 800# sandpaper, washed with distilled water, degreased with ethanol, and the workpieces of group C2, group C3, group C4, group C5, group C6, and group C7 submerged into the vanadate solutions (row C2, row C3, row C4, row C5, row C6, and row C7) shown in FIG. 4 correspondingly for about 2 minutes to form the protective films on the workpieces; followed by washing with distilled water and drying at 100° C. The magnesium alloy workpiece of group C1 is not treated with vanadate solution.

Referring to FIG. 4, a test result of the workpieces is shown. Corrosion potential and corrosion resistance were evaluated after submerging the workpieces into 5% sodium chloride (NaCl) solution for about 8 hours (teat area is 13.8 square centimeters). The corrosion potential was obtained by using saturation $Hg/Hg_2Cl_2$ electrode as the reference electrode. The corrosion resistance was measured by an impedance analyzer (R600, Gamry Instruments©), and evaluated by ASTM G106.

As shown in FIG. 4, corrosion resistance of the magnesium alloy workpieces after conversion treating by vanadate solutions shown in row C3, row C4, row C5, row C6, and row C7 was higher than that of the magnesium alloy workpieces of group C1 which was not treated by vanadate solution. Corrosion potential of the magnesium alloy workpieces after conversion treating by vanadate solutions shown in row C3, row C4, row C5, row C6, and row C7 which contain gallic acid was lower than that of the magnesium alloy workpieces of group C1, which was not treated by the vanadate solution and the magnesium alloy workpieces after conversion treating by the vanadate solutions shown in row C2 which contain no gallic acid. Therefore, the magnesium alloy workpiece after conversion treating by the vanadate solutions shown in row C3, row C4, row C5, row C6, and row C7 of FIG. 4 have good corrosion resistance. It was found that if the concentration of gallic acid is less than one fifth of that of sodium metavanadate, the magnesium alloy workpiece after conversion treating thereby exhibits relative higher corrosion resistance.

Example four: three groups (group D1, group D2 and group D3) of the magnesium alloy workpieces were provided. A material of each of the magnesium alloy workpieces is AZ91D. The three groups of the magnesium alloy workpieces were sanded using 800# sandpaper, washed with distilled water, degreased with ethanol, and the workpieces of group D1, group D2 and group D3 were submerged into the vanadate solutions (row D1, row D2 and row D3) shown in FIG. 5 correspondingly for about 2 minutes to form protective films on the workpieces; followed by washing with distilled water and drying at 100° C. The concentration of sodium metavanadate and gallic acid of vanadate solutions of row D1, row D2 and row D3 are the same respectively, but the pH values are different.

Corrosion resistance, surface resistance, and quantity of corrosion of three groups of the magnesium alloy workpieces were evaluated after the processes described. The corrosion resistance was evaluated by a salt spray tester using 5% sodium chloride (NaCl) solution for about 8 hours, grade of corrosion area was evaluated by ASTM-B117. The surface resistance was evaluated using a micro-ohmmeter (Lorester EP ' Mitsubishi Chemical). The quantity of corrosion was measure by weighing after drying.

As shown in FIG. 5, surface resistance of the magnesium alloy workpieces after conversion treating by vanadate solutions shown in row D1, row D2 and row D3 was all less than 1Ω. The corrosion resistance of the magnesium alloy workpiece after conversion treating by vanadate solutions shown in row D2 (the pH value is 2) was above grade 8, and the quantity of corrosion was within a acceptable level. It was found that if the pH value is 2, the magnesium alloy workpiece after conversion treating exhibits excellent corrosion resistance.

It should be pointed out that the magnesium alloy workpiece may be submerged into an acid pickling solution and an alkali pickling solution to remove the oxides on an outer surface of the workpiece instead of sanding.

Example five: three magnesium alloy workpieces are provided. A material of each of the magnesium alloy workpieces is AZ91D. The three magnesium alloy workpieces were degreased with degreasing solution (Concentration of the degreasing solution is 30 gram/liter, JASCO S-0717), submerged into a surface active agent (volume percentage is 15%, JASCO ME-410), submerged into a surface conditioning agent (volume percentage is 15%, JASCO MD-420) to remove the oxides on an outer surface of the workpieces, submerged into a vanadate solution to form a protective film on the workpieces, concentration of the sodium metavanadate is $2.46\times10^{-2}$ mol/liter, the concentration of the gallic acid is $2.46\times10^{-2}$ mol/liter, pH value is 2, washed with distilled water, dried at 100° C., sprayed polyester primer on the outer surface and propylene top finish to form a coating.

The bonding strength of the coating was evaluated by cross-cut test. The grade of the bonding strength was evaluated by ISO 2409.

The coating of the three magnesium alloy workpieces remained intact during cross-cut testing, and the bonding strength was all 0 grade. It is understood that if the magnesium alloy workpieces are used to make portable electronic devices, the coating on the outer surface of the portable electronic devices will not easily scale off.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A coating solution for conversion treating of surface of magnesium alloy, comprising: $8.20\times10^{-4}$ to $8.20\times10^{-2}$ mol/liter of metavanadate ion, $1.18\times10^{-4}$ to $1.18\times10^{-2}$ mol/liter of a polyhydroxylated aromatic compound, and balance of water, wherein a pH value of the coating solution exceeds 1 and is less than 4.

2. The coating solution of claim 1, wherein the metavanadate ion is provided by at least one of sodium metavanadate and ammonium metavanadate.

3. The coating solution of claim 1, wherein the metavanadate ion is obtained by dissolving vanadium pentoxide into a vanadate solution.

4. The coating solution of claim 1, wherein the polyhydroxylated aromatic compound is tannic acid, L-ascorbic acid, gallic acid, or their combination.

5. The coating solution of claim 1, wherein the pH value of the coating solution is regulated by one or more organic acids.

6. The coating solution of claim 1, wherein the pH value of the coating solution is regulated by one or more inorganic acids.

7. The coating solution of claim 6, wherein the inorganic acid is nitric acid, sulfuric acid, phosphoric acid, hydrochloric acid or their combination.

8. The coating solution of claim 1, wherein the pH value is 2.

9. The coating solution of claim 1, wherein the concentration of the polyhydroxylated aromatic compound is less than one fifth of that of the metavanadate ion.

10. A method for preparing a coating solution for conversion treating of a surface of a magnesium alloy workpiece, comprising:

dissolving metavanadate or vanadium pentoxide into water at a temperature of 50° C. to prepare a solution;

dissolving a polyhydroxylated aromatic compound into the solution;

regulating the molar concentration of metavanadate ion and the polyhydroxylated aromatic compound, wherein the concentration of metavanadate ions in the basic solution is $8.20\times10^{-4}$ to $8.20\times10^{-2}$ mol/liter, the concentration of the polyhydroxylated aromatic compound is $1.18\times10^{-4}$ to $1.18\times10^{-2}$ mol/liter, and the pH value of the coating solution exceeds 1 and is less than 4.

11. The method of claim 10, wherein the metavanadate is provided by at least one sodium metavanadate, ammonium metavanadate, or their combination.

12. The method of claim 10, wherein the polyhydroxylated aromatic compound is tannic acid, L-ascorbic acid, gallic acid, or their combination.

13. The method of claim 10, wherein the pH value of the coating solution is regulated by one or more organic acid.

14. The method of claim 10, wherein the pH value of the coating solution is regulated by one or more inorganic acid.

15. The method of claim 14, wherein the inorganic acid is nitric acid, sulfuric acid, phosphoric acid, hydrochloric acid or their combination.

16. The method of claim 10, wherein the pH value is 2.

17. The method of claim 10, wherein the concentration of the polyhydroxylated aromatic compound is less than one fifth of that of the metavanadate ion.

* * * * *